US010888166B2

(12) United States Patent
Gunawardena

(10) Patent No.: US 10,888,166 B2
(45) Date of Patent: Jan. 12, 2021

(54) STAIR BLOCK CUSHION

(71) Applicant: Dilshan Nadeepa Gunawardena, Coopersburg, PA (US)

(72) Inventor: Dilshan Nadeepa Gunawardena, Coopersburg, PA (US)

( * ) Notice: Subject to any disclaimer, the term of this patent is extended or adjusted under 35 U.S.C. 154(b) by 131 days.

(21) Appl. No.: 16/217,213

(22) Filed: Dec. 12, 2018

(65) Prior Publication Data

US 2020/0190894 A1 Jun. 18, 2020

(51) Int. Cl.
*A47C 13/00* (2006.01)
*A47L 13/00* (2006.01)
*A47C 3/16* (2006.01)

(52) U.S. Cl.
CPC ..... *A47C 13/00* (2013.01); *A47C 3/16* (2013.01); *A47L 13/00* (2013.01)

(58) Field of Classification Search
CPC ..... A47C 3/16; A47C 13/00
See application file for complete search history.

(56) References Cited

U.S. PATENT DOCUMENTS 561,900 A * 6/1896 Levinge
4,192,032 A * 3/1980 Geraci ..... A47G 9/0246 5/497
4,321,294 A * 3/1982 Naka ..... A47G 27/06 428/100
4,455,797 A * 6/1984 Naka ..... E04F 11/163 52/179
4,599,835 A * 7/1986 Rinke ..... E04H 4/144 52/169.7
6,691,356 B1 * 2/2004 Coma ..... A47C 4/52 5/417
2006/0001545 A1 * 1/2006 Wolf ..... G08B 21/0461 340/573.1

FOREIGN PATENT DOCUMENTS

DE 20 2018 003 515 * 10/2018
GB 2 397 515 * 7/2004

* cited by examiner

*Primary Examiner* — Gregory J Strimbu
(74) *Attorney, Agent, or Firm* — Dunlap Bennett & Ludwig, PLLC

(57) ABSTRACT

A cushion including a plush material and formed in a step shape. The step shape includes a rear surface vertically disposed, a bottom surface horizontally disposed, a first L-shaped sidewall vertically disposed, a second L-shaped sidewall vertically disposed, a first front vertical surface extending upward from the bottom surface, a horizontal front surface extending rearward from the first front vertical surface, a second front vertical surface extending upward from the horizontal front surface, and a top horizontal surface extending rearward from the second front vertical surface and adjoining with the rear surface. The step shape of the cushion enables the present invention to be utilized in a method of blocking a stairway.

4 Claims, 6 Drawing Sheets

STAIR BLOCK CUSHION

BACKGROUND OF THE INVENTION

The present invention relates to blocking a stairway and, more particularly, to a stair bock cushion.

Frequently when taking care of toddlers, a parent can't keep the toddler from climbing up stairs. Gates may be used to prevent toddlers from climbing up the stairs. However, gates can be cumbersome to install and involves a lot of hardware that can't easily be removed. Also, a gate is unsightly, difficult to remove when guests are over, and presents a tripping hazard. While a gate is great for keeping infants from going down stairs, it is unnecessary at the stair bottom.

As can be seen, there is a need for a stair block cushion that is easily placed and removed to block a stairway.

SUMMARY OF THE INVENTION

In one aspect of the present invention, a cushion comprises: a plush material formed in a step shape comprising a rear surface vertically disposed, a bottom surface horizontally disposed, a first L-shaped sidewall vertically disposed, a second L-shaped sidewall vertically disposed, a first front vertical surface extending upward from the bottom surface, a horizontal front surface extending rearward from the first front vertical surface, a second front vertical surface extending upward from the horizontal front surface, and a top horizontal surface extending rearward from the second front vertical surface and adjoining with the rear surface.

In another aspect of the present invention, a method of blocking a stairway comprises: providing a cushion comprising a plush material formed in a step shape comprising a rear surface vertically disposed, a bottom surface horizontally disposed, a first L-shaped sidewall vertically disposed, a second L-shaped sidewall vertically disposed, a first front vertical surface extending upward from the bottom surface, a horizontal front surface extending rearward from the first front vertical surface, a second front vertical surface extending upward from the horizontal front surface, and a top horizontal surface extending rearward from the second front vertical surface and adjoining with the rear surface; and placing the first front vertical surface against a first riser of the stairway, the horizontal front surface against a first tread of the stairway, and the second front vertical surface against a second riser of the stairway.

These and other features, aspects and advantages of the present invention will become better understood with reference to the following drawings, description and claims.

DETAILED DESCRIPTION OF THE INVENTION

Figure 1:
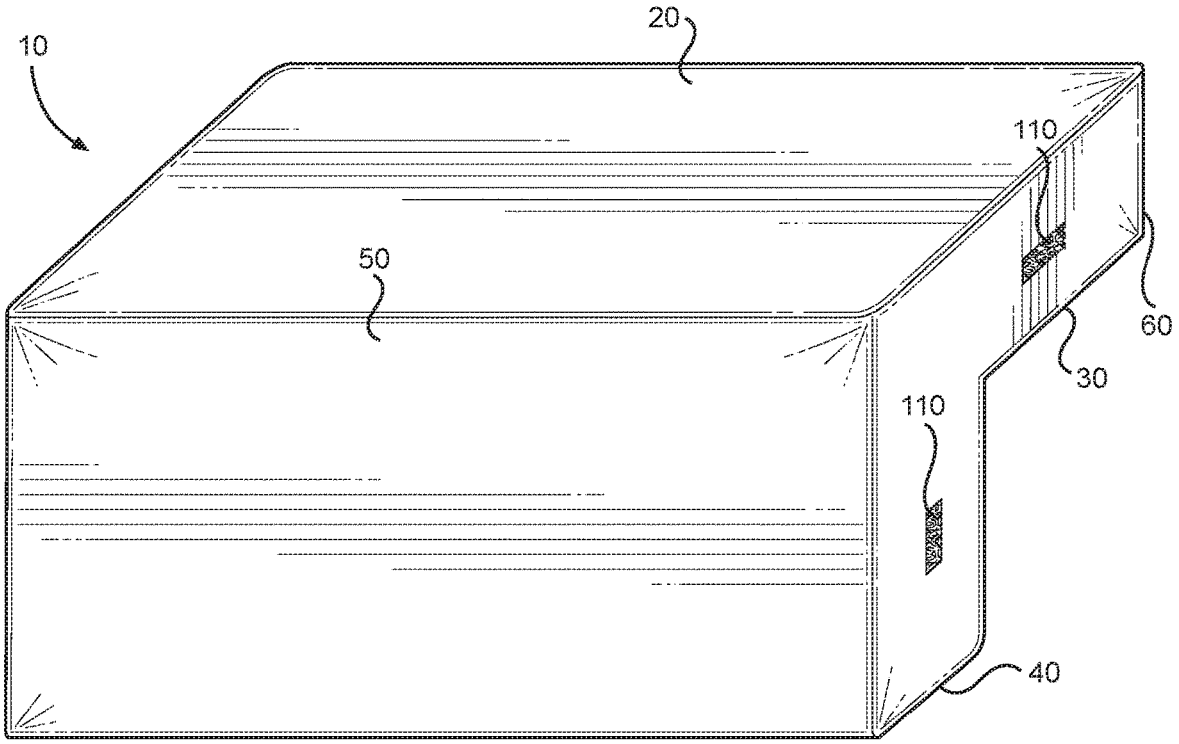
FIG. 1 is a perspective view of an embodiment of the present invention.
Figure 2:
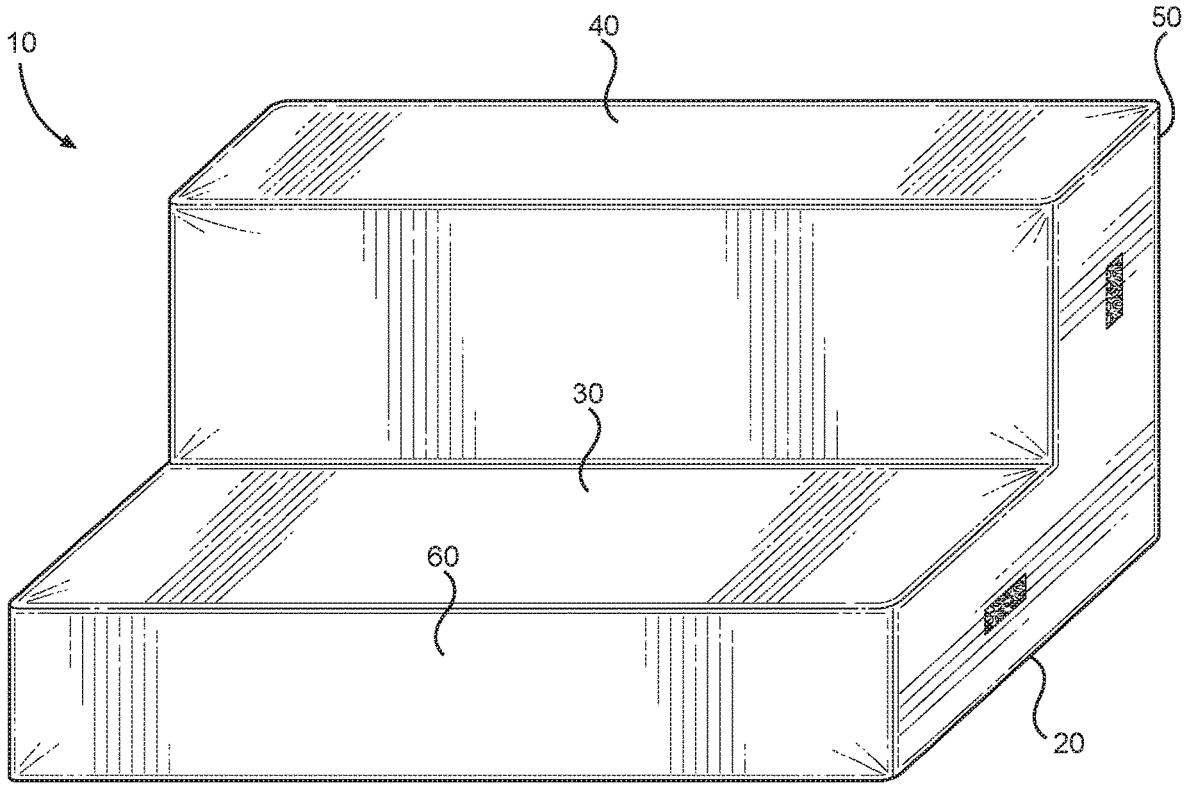
FIG. 2 is a rear perspective view of an embodiment of the present invention.
Figure 3:
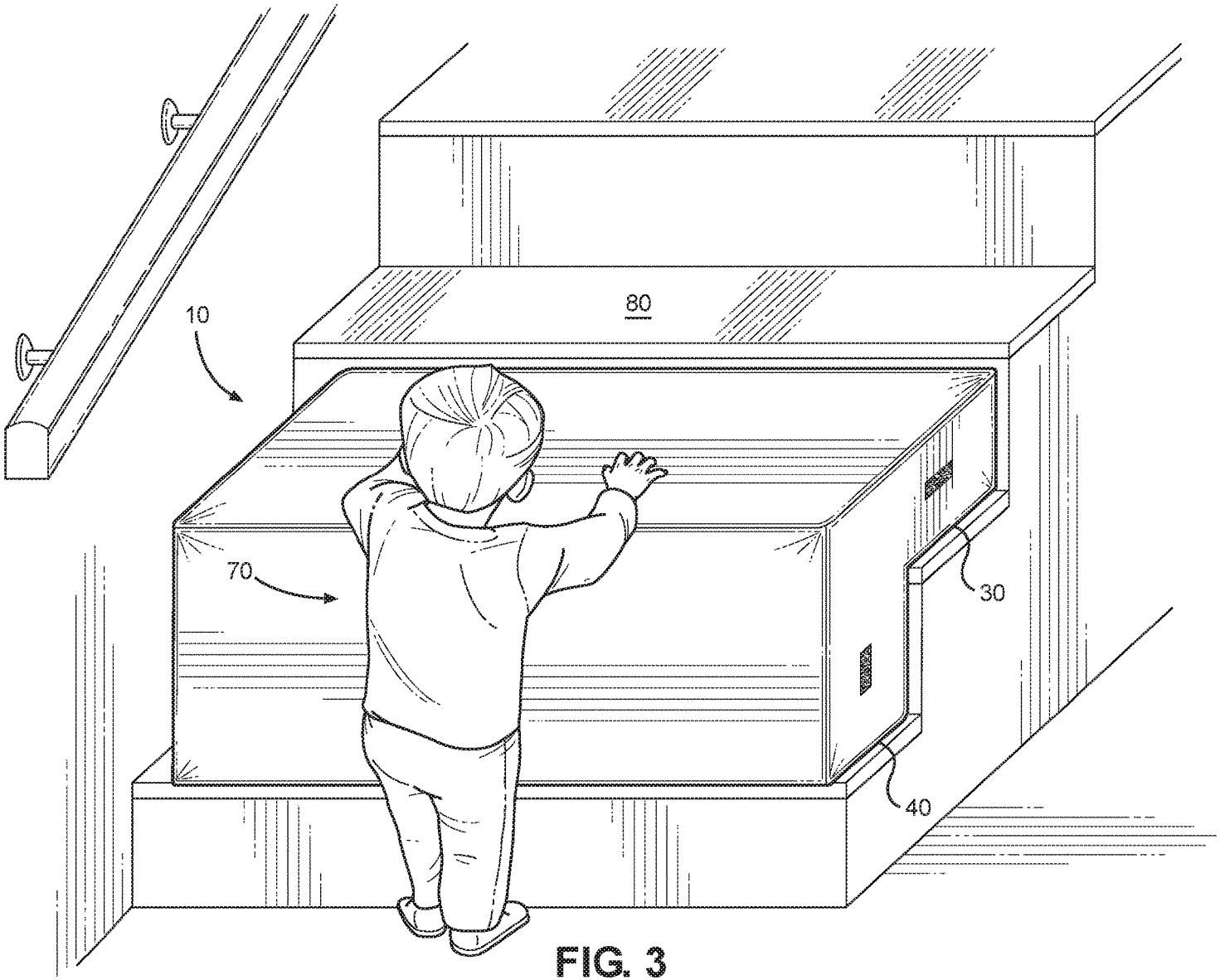
FIG. 3 is a perspective view of an embodiment of the present invention shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a stair bottom cushion that prevents toddlers from climbing up the stairs. The cushion is in the shape of the stairs and fits over the bottom stairs. The cushion may also reverse and be used as a seat for toddlers. The present invention allows a mother/father to quickly place the cushion on the stair bottom preventing the infant from climbing up. No hardware installation is necessary.

Referring to FIGS. 1 through 7, the present invention includes a cushion 10. The cushion 10 includes a plush material 100 formed in a step shape. The step shape includes a rear surface 50 vertically disposed, a bottom surface 20 horizontally disposed, a first L-shaped sidewall 12 vertically disposed, a second L-shaped sidewall 14 vertically disposed, a first front vertical surface 60 extending upward from the bottom surface 20, a horizontal front surface 30 extending rearward from the first front vertical surface 60, a second front vertical surface 18 extending upward from the horizontal front surface 30, and a top horizontal surface 40 extending rearward from the second front vertical surface and adjoining with the rear surface 50.

The plush material 100 of the present invention may include filler material enclosed in a fabric outer cover 90. The outer cover 90 may take the shape of the cushion 10 an may thereby be formed in the step shape. The outer cover 90 may further include a gripping material to grip to the stairway 80. The outer cover 90 may be made of cloth, such as silk, cotton, polyester, or a combination thereof. The filler material may be synthetic or natural filler. Synesthetic fillers may include plastic fibers, viscoelastic foam, sand, and latex. Natural fillers may include feathers, down, wool, cotton, buckwheat, or a combination thereof.

Figure 6:
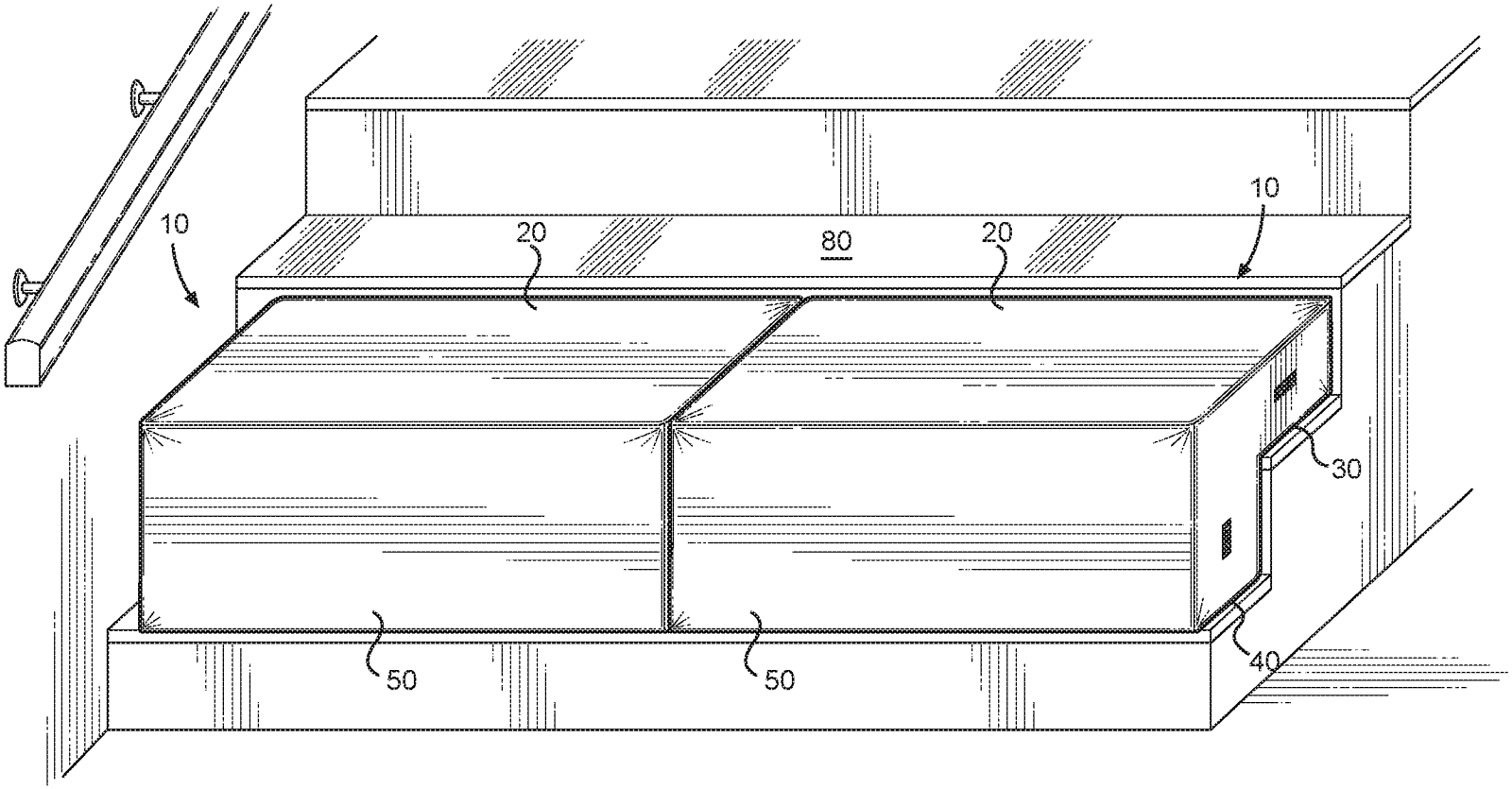
FIG. 6 is a perspective view of an embodiment of the present invention shown in use.
Figure 7:
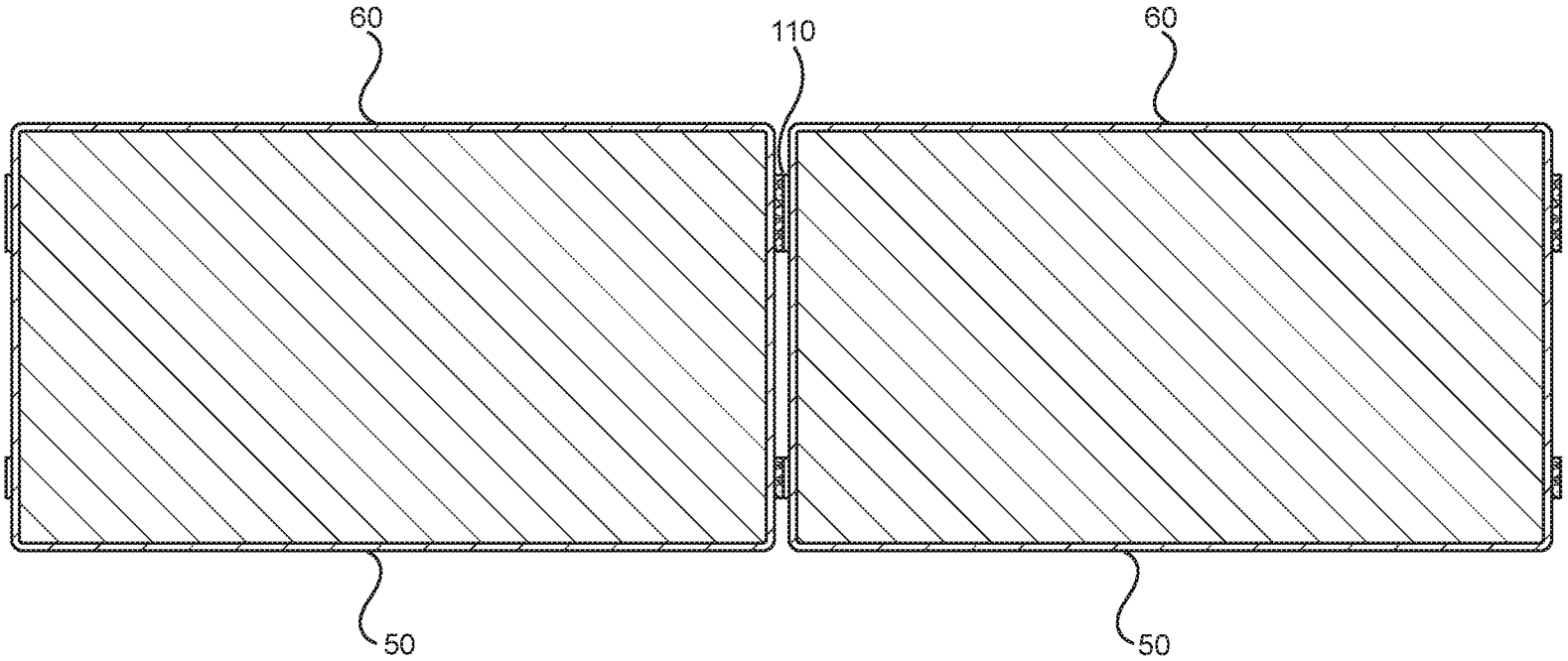
FIG. 7 is a top cross-sectional view of an embodiment of the present invention.

The present invention may further include connectors 110 coupled to the first and second L-shaped sidewalls 12, 14. The connectors 110 are configured to connect with other connectors 110 of other cushions 10. As illustrated in FIGS. 6 and 7, multiple cushions may be joined together by the connectors 110. The connectors 110 may include, but is not limited to, a hook and loop material, ties, clips, snaps, and the like.

Figure 4:
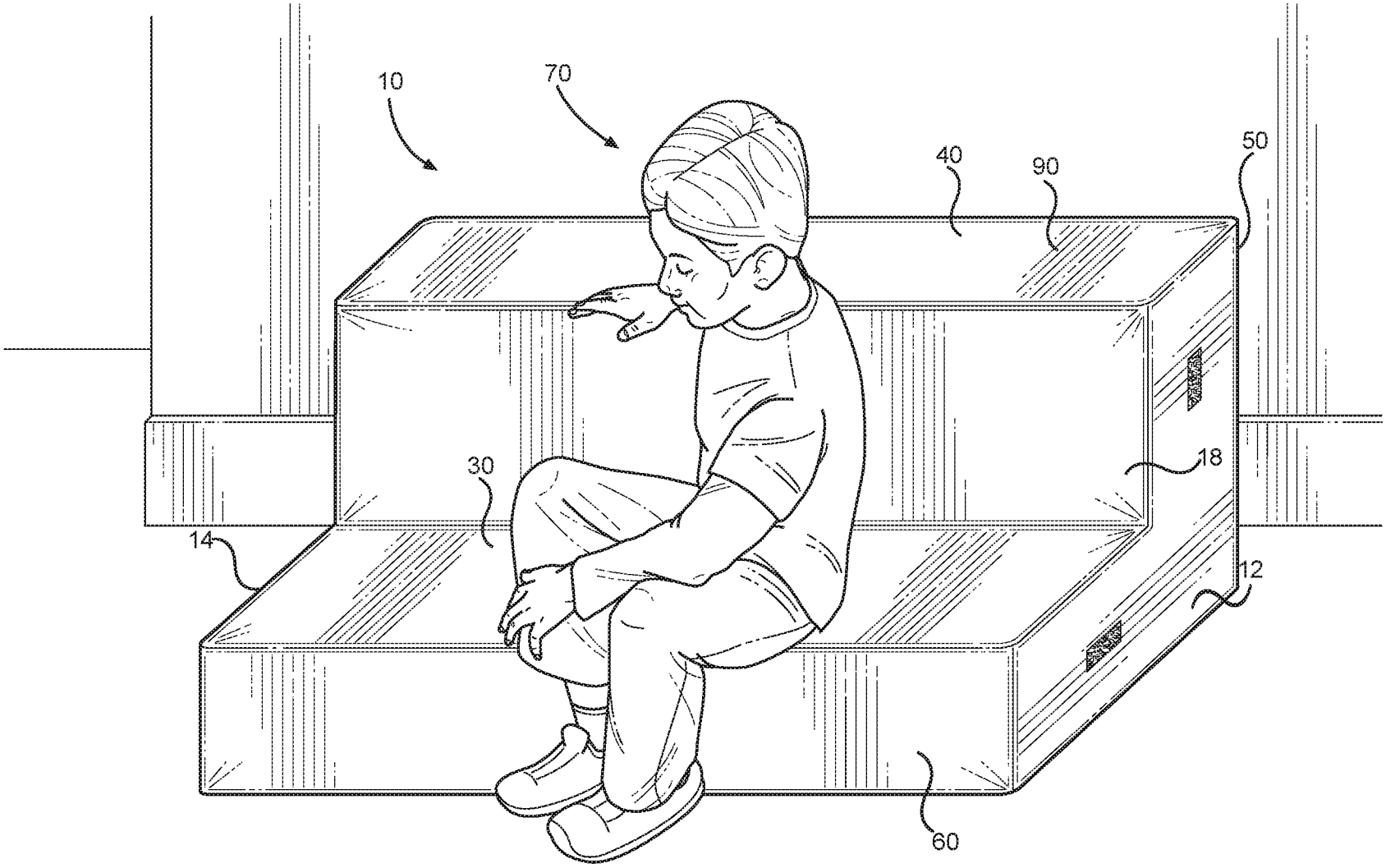
FIG. 4 is a perspective view of an embodiment of the present invention shown in use.
Figure 5:
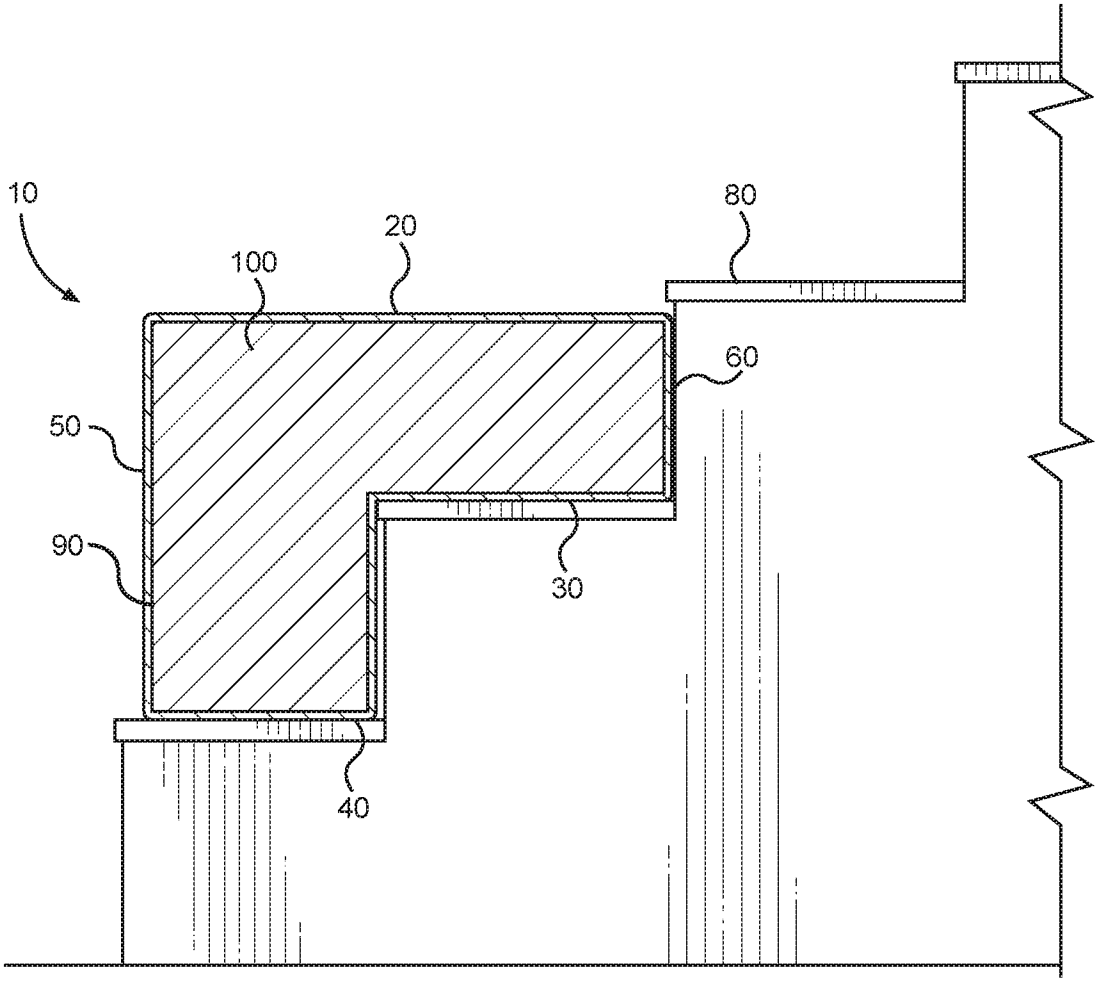
FIG. 5 is a cross-sectional view of an embodiment of the present invention shown in use.

A method of blocking a stairway 80 may include the following. Provide the cushion 10 described above. Place the first front vertical surface 60 against a first riser of a stairway 80, the horizontal front surface 30 against a first tread of the stairway 80, and the second front vertical surface 18 against a second riser of the stairway 80. The cushion 10 then blocks the stairway 80 so that toddlers 70 may not freely climb up the stairs. Further, adults may easily move the cushion or step over the cushion to climb the stairs. When the cushion 10 is facing right side up, the toddler 70 may use the cushion 10 as a seat, as illustrated in FIG. 4.

It should be understood, of course, that the foregoing relates to exemplary embodiments of the invention and that modifications may be made without departing from the spirit and scope of the invention as set forth in the following claims.

What is claimed is:

1. A method of blocking a stairway comprising:

providing a cushion having a step shape and comprising a rear surface vertically disposed, a bottom surface horizontally disposed, a first L-shaped sidewall vertically disposed, a second L-shaped sidewall vertically disposed, a first front vertical surface extending upward from the bottom surface, a horizontal front surface extending horizontally from the first front vertical surface toward the rear surface, a second front vertical surface extending upward from the horizontal front surface, and a top horizontal surface extending horizontally from the second front vertical surface and adjoining with the rear surface; and blocking the stairway by placing the first front vertical surface against a first riser of the stairway, the horizontal front surface against a tread of the stairway extending horizontally from said first riser, and the second front vertical surface against a second riser of the stairway extending downwardly from said tread.

2. The method of claim 1, further comprising an outer cover encasing the cushion.

3. The method of claim 1, further comprising connectors coupled to the first and second L-shaped sidewalls and configured to connect with other connectors of other cushions.

4. The method of claim 3, wherein the connectors are hook and looped fasteners.

* * * * *